US005867833A

United States Patent [19]

LeDonne

[11] Patent Number: 5,867,833

[45] Date of Patent: Feb. 9, 1999

[54] PLIABLE GARMENT TO BE WORN ABOUT THE HEAD

[76] Inventor: Eileen A. LeDonne, 16 Green St., Everett, Mass. 02149

[21] Appl. No.: 770,459

[22] Filed: Dec. 20, 1996

[51] Int. Cl.[6] ..... A41D 23/00

[52] U.S. Cl. ..... 2/171; 2/207; 2/DIG. 11

[58] Field of Search ..... 2/171, 207, DIG. 11, 2/311, 338, 339; 174/113 R; 132/273

[56] References Cited

U.S. PATENT DOCUMENTS

| | | | |
|---|---|---|---|
| Re. 27,854 | 12/1973 | Schoerner et al. | 174/113 R |
| 1,287,626 | 12/1918 | Brett | 2/171 |
| 4,464,425 | 8/1984 | Voigt et al. | 428/34.9 |
| 5,233,704 | 8/1993 | Booher | 2/207 |
| 5,598,585 | 2/1997 | Stroup | 2/171 |
| 5,621,921 | 4/1997 | Outland | 2/171 |
| 5,664,589 | 9/1997 | Black | 132/273 |
| 5,694,955 | 12/1997 | Grooms | 132/273 |
| 5,706,838 | 1/1998 | St. James | 132/273 |

FOREIGN PATENT DOCUMENTS

| | | | |
|---|---|---|---|
| 881256 | 4/1943 | France | 2/311 |
| 5276 | 5/1900 | United Kingdom | 2/311 |

*Primary Examiner*—Diana L. Biefeld
*Attorney, Agent, or Firm*—Kudirka & Jobse, LLP

[57] ABSTRACT

An article of apparel to be worn about the head includes an elongate sleeve of material having an elongate pliable member extending at least partially through the sleeve. The ends of the article are securable about the head so that at least a portion of the head and ears are covered, with the pliable member providing all or a portion of the facilities for securing and maintaining the device about the head.

6 Claims, 5 Drawing Sheets

Figue 4A

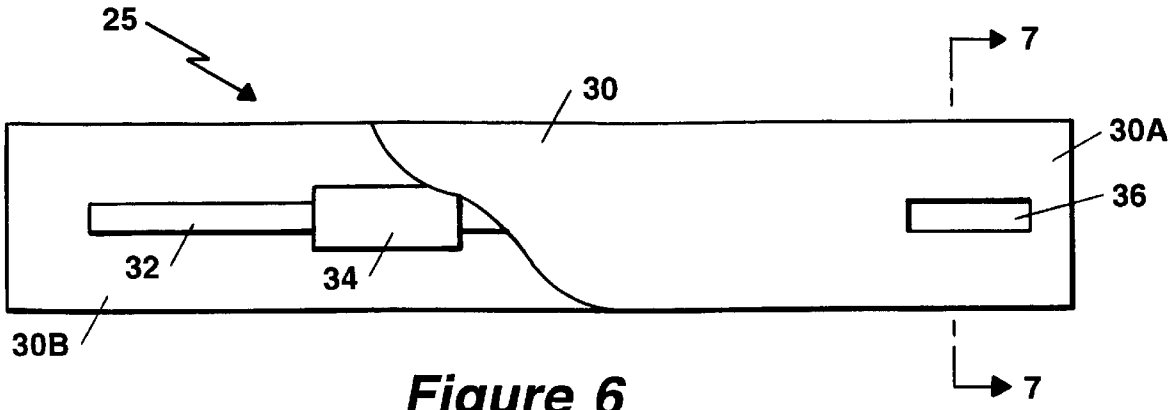
Figure 6
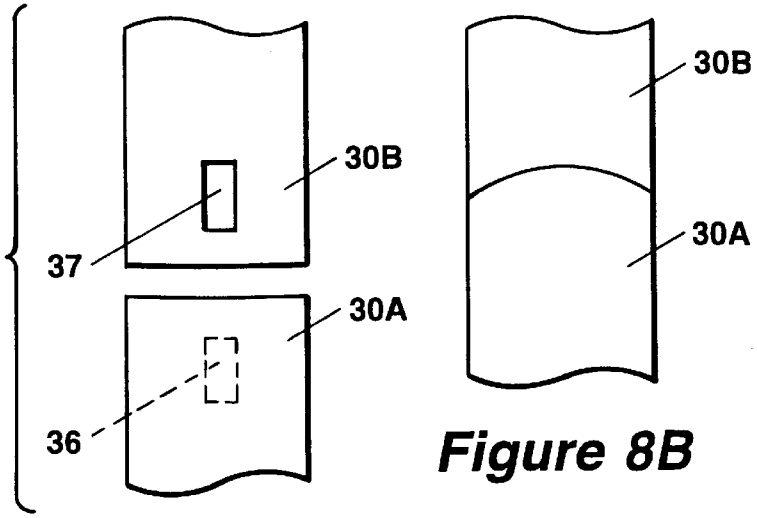
Figure 8A
Figure 8B

PLIABLE GARMENT TO BE WORN ABOUT THE HEAD

FIELD OF THE INVENTION

The present invention relates to clothing apparel, and, specifically, to a garment which is both pliable and securable about the human head.

BACKGROUND OF THE INVENTION

Numerous articles of clothing are available for wearing on or about the human head. Some articles, such as scarves, bandanas, headbands and hair clips may have both utilitarian function as well as fashionable appeal. Apparel used for winter clothing usually serves the functions of insulating all or a portion of the head. Items such as hats, scarves and headbands are marketed in a variety of sizes for adults as well as children. However, within a specific size category, the items have a "one size fits all" design which typically includes elastic to keep the article close to the head. As a result such items are often overly tight and difficult to fit around one's head, often disturbing one's hairstyle and, particularly for women, one's cosmetic makeup. In addition, children often times resist having such tight fitting garments pulled across their head and face. Other items, such as certain earmuff designs may be selectively sized to one's head by use of a telescoping mechanism connecting the two ear covering elements. Such articles, however, often times do not remain securely on an individual's head, especially during outdoor physical activity. As a result, the comfort and protection derived from the earmuffs is less than optimal.

Accordingly, a need exists for an article of clothing which can be custom fitted to the unique shape of an individual's head, which will not disturb and individual's appearance during dressing, and which provides a secure, comfortable, and protective covering to at least a portion of the head.

SUMMARY OF THE INVENTION

The above-described deficiencies of prior devices and previously described needs are fulfilled by the present invention which contemplates an article to be worn about the head comprising a pliable member capable of being shaped about the head and an external covering surrounding the pliable member. In one embodiment, the pliable member comprises a metal wire and the external covering comprises either a natural or synthetic material. In an alternative embodiment, an intermediate covering, at least partially surrounds the pliable member, and is disposed between the pliable member and the external covering.

In a second embodiment, an article to be worn about the human head comprises an elongate sleeve of material and an elongate pliable member extending at least partially through the sleeve. The elongate sleeve has first and second ends which are securable to one another about the head so that at least a portion of the head is covered. The ends may be bent together, or, alternatively, a fastening device provided for securing the ends together.

BRIEF DESCRIPTION OF THE DRAWINGS

The features, objects and advantages of the invention will be better understood by referring to the following detailed description in conjunction with the accompanying drawing in which:

FIG. 4A illustrates a partial view of an alternative embodiment of the article ends of FIG. 3A when unsecured;

FIG. 6 illustrates a cut away view of an alternative embodiment of the inventive article;

FIG. 8A is a partial view illustrating the article ends of FIG. 6 when unsecured;

FIG. 8B illustrates a partial view of the article ends of FIG. 8A when secured;

FIG. 9 illustrates a partial view of an alternative embodiment of the article ends of FIG. 6 when unsecured.

DETAILED DESCRIPTION

Figure 1A:
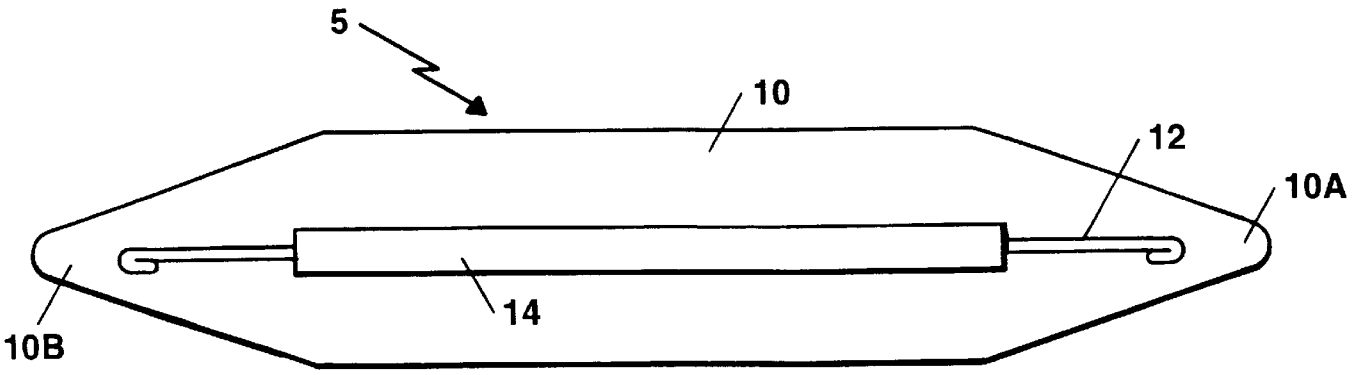
FIG. 1A illustrates the components of the inventive article in a partially assembled relation.
Figure 1B:
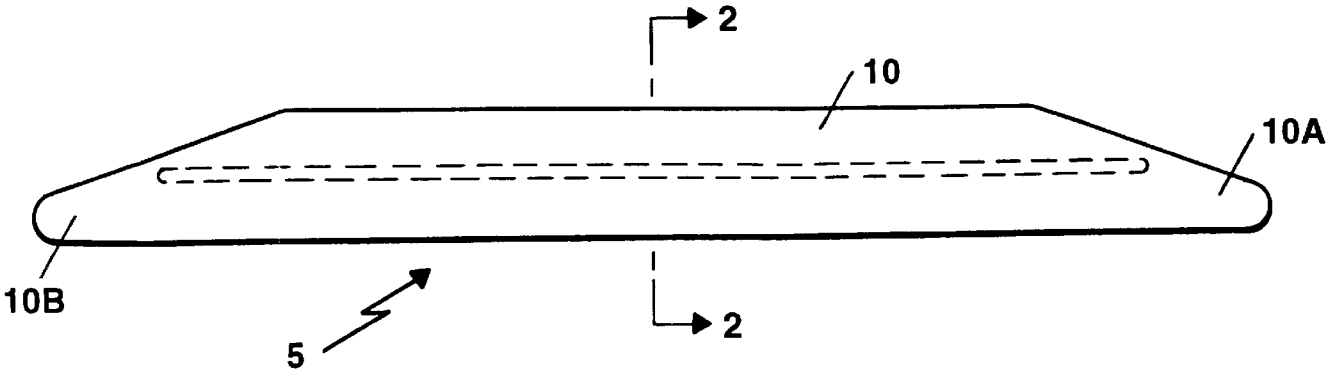
FIG. 1B illustrates the article of FIG. 1A when assembled, with the pliable member illustrated in phantom.
Figure 2:
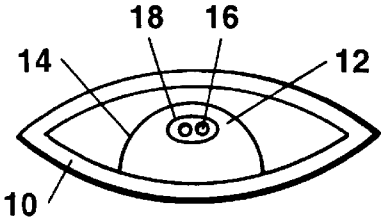
FIG. 2 is a cross-sectional view of the inventive article of FIG. 1B as seen along line 2—2 of FIG. 1B.

Referring to FIG. 1A, the components of the inventive garment in accordance with the present invention, hereafter referred to as the "article", are illustrated. Article 5 comprises an elongate member 12 contained within an external covering 10. As illustrated in FIG. 1A, elongate member 12 extends substantially the length of external covering 10. In the illustrative embodiment, elongate member 12 has pliable characteristics which allow it to be repeatedly bent or flexed without destroying the patency of the member. In the illustrative embodiment, member 12 comprises a metal wire. Alternatively, member 12 may comprise one or more wires, such as a pair of wires housed in a plastic insulative sheathing, as illustrated in FIG. 2, similar to standard electrical wire used with thermostats and other electrical devices. Such wire is commercially available from numerous hardware and building supply stores. The ends of the wire are bent to form a rounded surface for safety purposes. The gauge of the wire and the number of wires is a design choice dependent on the amount of pliability and flexibility desired within the article 5. The article is manufactured by placing the member 12 within the external covering 10, which, in the illustrative embodiment, is symmetrical in shape having a first end 10A and a second end 10B. The covering may then be folded in half and secured together, typically by stitching or other means, to form the article as illustrated in FIG. 1B, with member 12 being illustrated in phantom therein.

Figure 7:
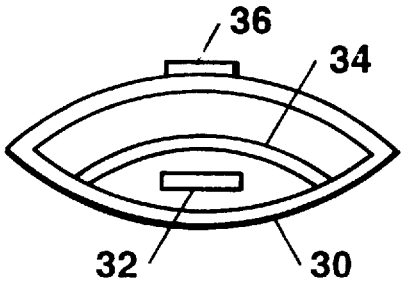
FIG. 7 illustrates a cross-sectional view of the article of FIG. 6 as seen along line 7–7 of FIG. 6.

In addition to metal having dimensions as previously described, other substances may be used for member 12 such as certain plastics which exhibit pliable characteristics similar to metal and which may have either a circular cross section, as illustrated in FIG. 2, or a rectangular cross section, as illustrated in FIG. 7, as described hereinafter.

External covering 10 may comprise any fabric or material which provides insulative properties, including but not limited to naturally occurring fibers such as cotton, wool, or mohair, or synthetic materials, such as Dacron, Rayon, or Polyester. In the illustrative embodiment, a synthetic fleece material known as Polartec™ commercially available from Malden Mills, Lawrence, Mass. is utilized for external covering 10. The fleece material provides an enhanced degree of warmth to the body surfaces with which external covering 10 comes into contact.

It will be obvious to those reasonably skilled in the arts that other types of materials may be used and that different combinations of material may be used. For instance, the internal side of external covering 10, the side worn next to the body, may comprise a knit material, while the other, external side may comprise a different material such as natural or synthetic animal fur.

To help stabilize the position of member 12 within the external covering, an optional sleeve 14 may be utilized to limit the movement of member 12 within external covering 10, particularly during shaping. The sleeve may comprise a fabric material or a synthetic foam, such as urethane or polyurethane. The sleeve may be secured to the external covering 10 or may remain within external covering 10 through frictional forces. Alternatively, sleeve 14 may comprise one or more securing devices, such as strips of elastic attached to external covering 10. In addition to, or in place of, sleeve 14, a material such as synthetic or natural down or a natural or synthetic batt material may fill any interior cavity between pliable member 12 and external covering 10 to provide both increased insulative properties to article 5 as well as to stabilize the position of pliable member 12 within external covering 10.

Figure 4B:
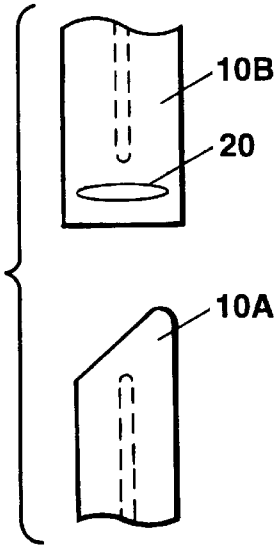
FIG. 4B illustrates a partial view of the article ends of FIG. 4A when secured in accordance with the alternative embodiment.
Figure 4B:
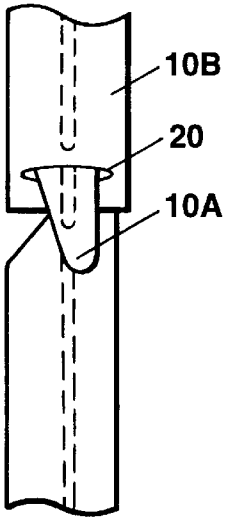
Figure 5:
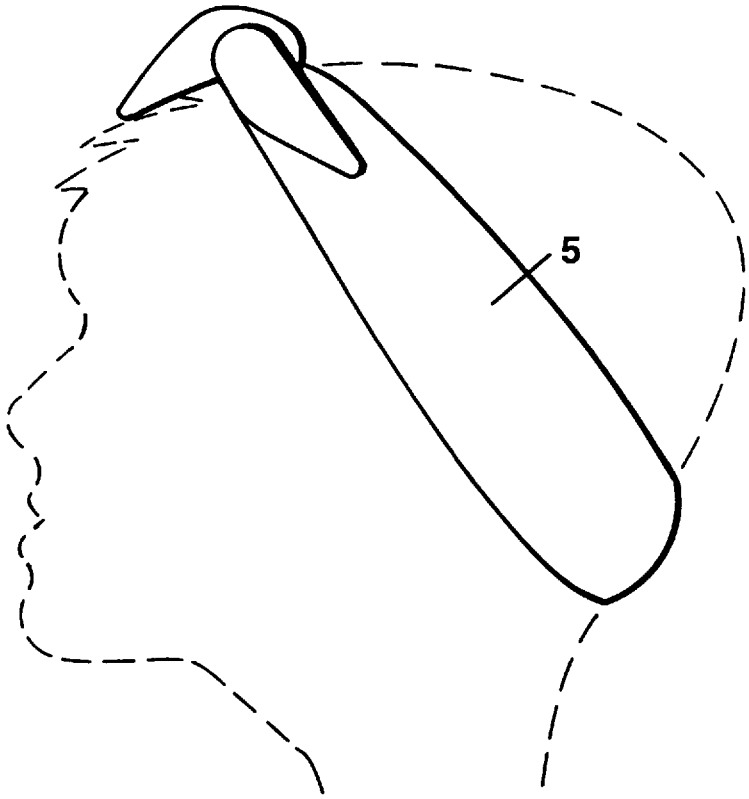
FIG. 5 illustrates the article as worn about the head, with the subject illustrated in phantom.

The article 5 is worn about the head of a subject as illustrated in FIG. 5. First, the article is centered about the back of the neck. Next, the user forms the shape of member 12 about the head so that the article wraps comfortably along the sides of the head and partially around the ears so that ends 10A and 10B meet at the top of the head. Finally, article ends 10A and 10B are secured in a manner as illustrated with reference to FIGS. 3 and 4.

Figure 3A:
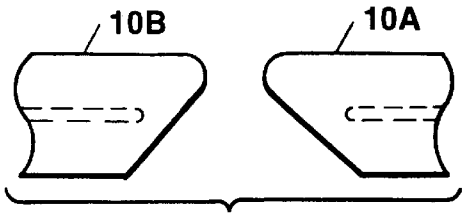
FIG. 3A illustrates a partial view of the unsecured ends of the article of FIG. 1B.
Figure 3B:
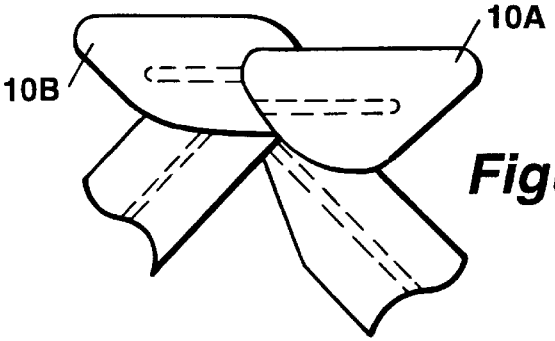
FIG. 3B illustrates a partial view of the article ends of FIG. 3A when secured.

Referring to FIG. 3A, first end 10A and second end 10B of article 5 are illustrated in an unsecured relation to one another. FIG. 3B illustrates the ends 10A and 10B wrapped about each other in a manner similar to that shown in FIG. 5 to ensure a secure fit about the head of the subject. The pliable member 12 facilitates securing of the ends about one another by simply bending one end around the other end without requiring a knot or other securing means.

As will be appreciated from the above description, the article of apparel as disclosed herein provides a garment which can be easily secured about the head to provide a comfortable protective covering to a portion of the head and ears, and which is custom fit to the unique shape of the individual's head.

An alternative embodiment to the embodiments of FIGS. 1–3 is illustrated in FIG. 4. In this embodiment, end 10B has a nontapered end with a hole or eyelet 20 extending therethrough. To secure end 10A to end 10B, the tapered end of 10A is slipped through the eyelet 20 and bent backward as illustrated in FIG. 4B. Pliable member 12 provides the means by which end 10A is held in place, as illustrated.

Referring to FIG. 6, another alternative embodiment of the article of the present invention is illustrated. Article 25, as illustrated, comprises an external covering 30 having a pliable member 32 extending substantially the length thereof, similar to the embodiment shown in FIG. 1. Ends 30A and 30B of external covering 30, however, do not have a tapered shapes. Further, the means by which ends 30A and 30B may be secured include additional securing means, as described hereinafter. In the embodiment disclosed in FIG. 6, pliable member 32 comprises an elongate metal or plastic element having a rectangular cross section. Optionally, one or more straps 34 may be attached to external covering 30 to facilitate stabilizing the position of the member 32 while still allowing movement of the member within external covering 30. FIG. 7 illustrates a cross sectional view of article 25 as seen along lines 7—7 of FIG. 6. Straps 34 may comprise elastic or other materials.

Figures 9A, 9B:
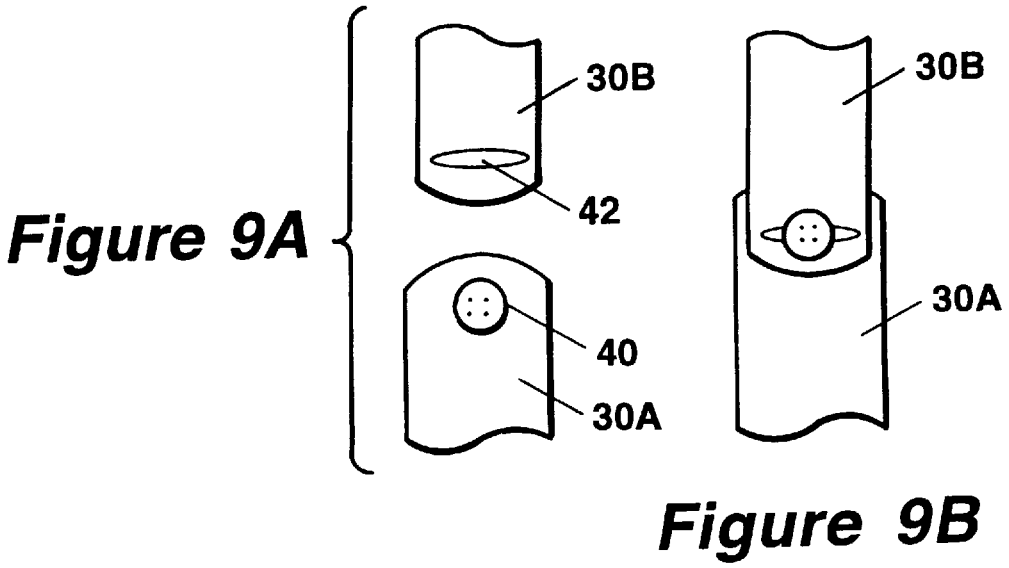
FIG. 9B illustrates a partial view of the article ends of FIG. 9A when secured.

Article 25 is secured about the head of a subject in a manner similar to that previously described, with reference to FIG. 5 except that ends 30A and 30B are secured differently. Referring to FIGS. 8A–B, a VELCRO™-like securing mechanism is illustrated. Specifically, element 36 may comprise a dense array of tiny nylon hooks while element 37 comprises a dense nylon pile. When pressed together, elements 36 and 37 frictionally engage, securing end 30A and 30B, as illustrated in FIG. 8B. Alternatively, the means for securing ends 30A and 30B may comprise a button 40 attached to end 30A and a hole or eyelet 42 extending through end 30B, as illustrated in FIG. 9A, which may be joined in a conventional manner as illustrated in FIG. 9B. Although not illustrated, other securing mechanisms such as snaps, hook/eyelet, etc., may be used in place of elements 36–37 of FIGS. 8A–B or button 40 and eyelet 42 of FIGS. 9A–B.

In the embodiments disclosed in FIGS. 6–9, although the pliable member 32 does not provide the means by which the respective ends remain secured, member 32 still serves to ensure a close fit about the head and ears of the subject and enables the respective ends to be brought into close contact for securing by the respective disclosed securing devices.

Although various exemplary embodiments of the invention have been disclosed, it will be apparent to those skilled in the art that various changes and modifications can be made which will achieve some of the advantages of the invention without departing from the spirit and scope of the invention. These and other obvious modifications are intended to be covered by the appended claims.

What is claimed is:

1. An article of apparel to be worn around a human head comprising:

an elongate sleeve of material having a first end portion having an eyelet extending therethrough; and an elongate pliable member extending at least partially through the sleeve.

2. The article of claim 1, wherein the elongate sleeve of material has a second end portion securable to the first end portion.

3. The article of claim 2 wherein the second end portion has a reduced width.

4. An article of apparel to be worn around a human head comprising:

a first elongate sleeve of fabric having first and second sleeve ends;

an elongate pliable member having a first and second pliable member ends and extending at least partially through the first elongate sleeve between the first and second sleeve ends; and a second sleeve, attached to the first elongate sleeve, for stabilizing the position of the elongate pliable member within the first sleeve.

5. The article of claim 4 wherein the first pliable member end is bendable into a J-shape around the second pliable member end to secure the article around a human head.

6. The article of claim 4 wherein the second pliable member end is bendable into a J-shape around the first pliable member end to secure the article around a human head.

* * * * *